US007814894B2

(12) United States Patent
Giroux

(10) Patent No.: US 7,814,894 B2
(45) Date of Patent: Oct. 19, 2010

(54) ANTI DRY-FIRE DEVICE FOR CROSSBOWS

(76) Inventor: Gaetan Giroux, 1700, Chemin Des Peres, St-Jean-Sur-Richelieu, Quebec (CA) J2W 2T1

( * ) Notice: Subject to any disclaimer, the term of this patent is extended or adjusted under 35 U.S.C. 154(b) by 510 days.

(21) Appl. No.: 11/934,441

(22) Filed: Nov. 2, 2007

(65) Prior Publication Data

US 2009/0114200 A1 May 7, 2009

(51) Int. Cl.
*F41B 5/12* (2006.01)

(52) U.S. Cl. ..... 124/25; 124/40

(58) Field of Classification Search ..... 124/25, 124/40

See application file for complete search history.

(56) References Cited

U.S. PATENT DOCUMENTS 4,192,281 A * 3/1980 King ..... 124/25
5,598,829 A 2/1997 Bednar
5,884,614 A 3/1999 Darlington
6,205,990 B1 3/2001 Adkins
6,425,386 B1 7/2002 Adkins
6,736,123 B1 5/2004 Summers
6,802,304 B1 10/2004 Chang
7,017,568 B1 3/2006 Smith
7,174,884 B2 2/2007 Kempf

* cited by examiner

*Primary Examiner*—John Ricci

(57) ABSTRACT

An anti dry-fire device for crossbows mounted on a viewfinder mount has a catch rotationally attached to a catch holder by way of an attachment pin. A catch biasing means to bias the catch. A lock-unlock means slidingly engaged on the top of the viewfinder mount. The lock-unlock means moving the catch from an operative mode into an inoperative mode.

5 Claims, 2 Drawing Sheets

ANTI DRY-FIRE DEVICE FOR CROSSBOWS

FIELD OF THE INVENTION

The present invention relates generally to crossbows but more particularly to a device to stop dry-fire.

BACKGROUND OF THE INVENTION

Crossbows are used for hunting nowadays. With the new fiberglass bows which are harder to bend, more pressure is exerted on the arrow by way of the string which translates into an arrow going over a much longer distance.

The problem with that is if an arrow is not present and that for some reason the string is triggered, that is called a dry-fire, and the bow, without the benefit of being slowed down by the departing arrow, unbends too rapidly, which can, more often than not, result in one or both sides of the bow to crack or even break.

In order to solve this problem, there are some crossbows that have an anti dry-fire system as part of their construction.

For example, one patent has the crossbow include a trigger mechanism comprised of a pivotal string catch member positioned relative to the trigger mechanism to selectively extend into a string catching position which will catch and retain the bowstring should it be released from the trigger mechanism without an arrow in a firing position in the crossbow. The string catch member includes an arrow contacting surface to engage an arrow positioned to be fired from the crossbow, wherein, movement of the arrow to the firing position causes the string catch member to be moved out of the string catching position. This allows selective release of the bowstring from the guide slot and prevents inadvertent release when no arrow is present in the firing position. The string catch member may be manually removed from the guide slot so as not to interfere with the bowstring, allowing a convenient mechanism to uncock the crossbow without firing.

But there does not appear to be any kits that allows for the retrofitting of an anti dry-fire device on existing crossbows.

SUMMARY OF THE INVENTION

In view of the foregoing disadvantages inherent in the known devices now present in the prior art, the present invention, which will be described subsequently in greater detail, is to provide objects and advantages which are:

To provide for an anti dry-fire device that is retrofittable to existing crossbows.

To provide for a simple yet efficient system of anti dry-fire for crossbows.

To attain these ends, the present invention has the anti dry-fire device mounted on a viewfinder mount and having a catch rotationally attached to a catch holder by way of an attachment pin. A catch biasing means to bias the catch. A lock-unlock means slidingly engaged on the top of the viewfinder mount. The lock-unlock means moving the catch from an operative mode into an inoperative mode.

The anti dry-fire device is also comprised of a biased ball bearing is selectively biased from a first cavity to a second cavity when the lock-unlock means is moved from unlock mode to lock mode.

The anti dry-fire device preferably has a stop and block restrain the range of motion of the lock-unlock means.

The anti dry-fire is ideally suited for retrofitting on an existing crossbow's viewfinder mount.

The anti dry-fire device has a mode of operation consisting in the steps of a user pulling a lock-unlock means in a direction opposite the way an arrow is to be released so as to allow a catch to pivot in an orientation that causes the catch to block the release of a string after the user has pulled the string so that the string passes the catch which allows passage of the string in one direction but not in the opposite direction; the user loads an arrow;

the user, when ready to fire, pushes the lock-unlock means in the way the arrow is to be released so as to pivot the catch out of the way of the string;

the user pulls the trigger to release the string and throw the arrow.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter which contains illustrated preferred embodiments of the invention.

DETAILED DESCRIPTION

Figure 1A:
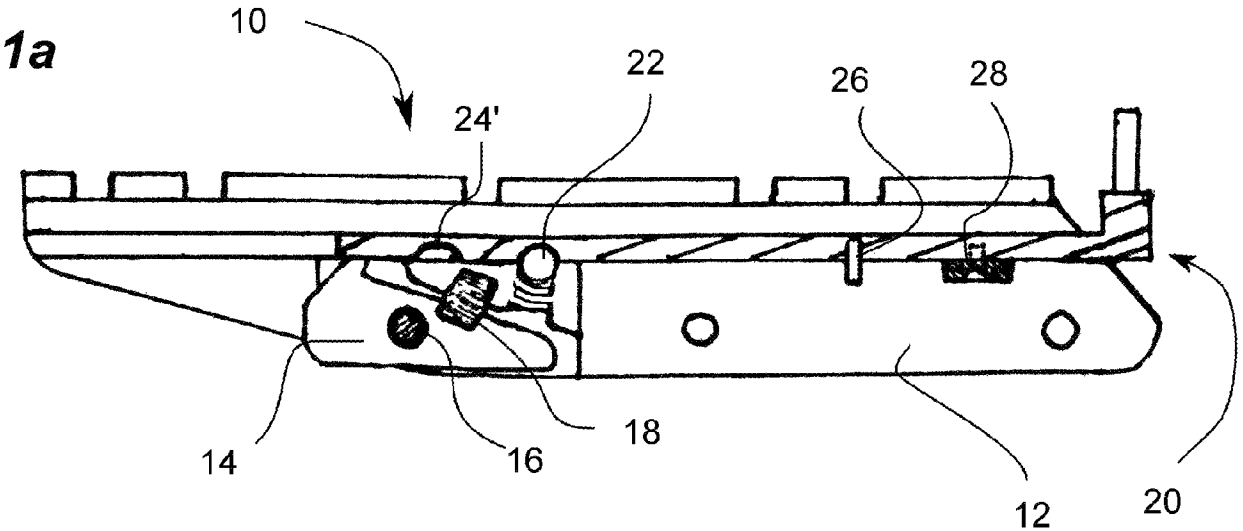
FIGS. 1*a-b* Cross-sectional side views of the device with the catch disengaged and engaged respectively.

An anti dry-fire device for crossbows (10) is mounted on a viewfinder mount (12). Viewfinder mounts of this type are well known in the art but this particular one has been modified to receive the exclusive components of this invention.

A catch (14) is rotationally attached to a catch holder (44) by way of an attachment pin (16). A catch biasing means (18) to bias the catch (14) as shown in FIG. 1*b*.

A lock-unlock means (20) is slidingly engaged on the top of the viewfinder mount (12). In FIG. 1*a*, the lock-unlock means (20) has lifted the catch (14) into its non operative mode. The string (19) will not be blocked when it is released. The lock-unlock means (20) accomplishes that by pushing forward on the catch (14) so as to pivot it out of the way of the string (19).

Figure 1B:
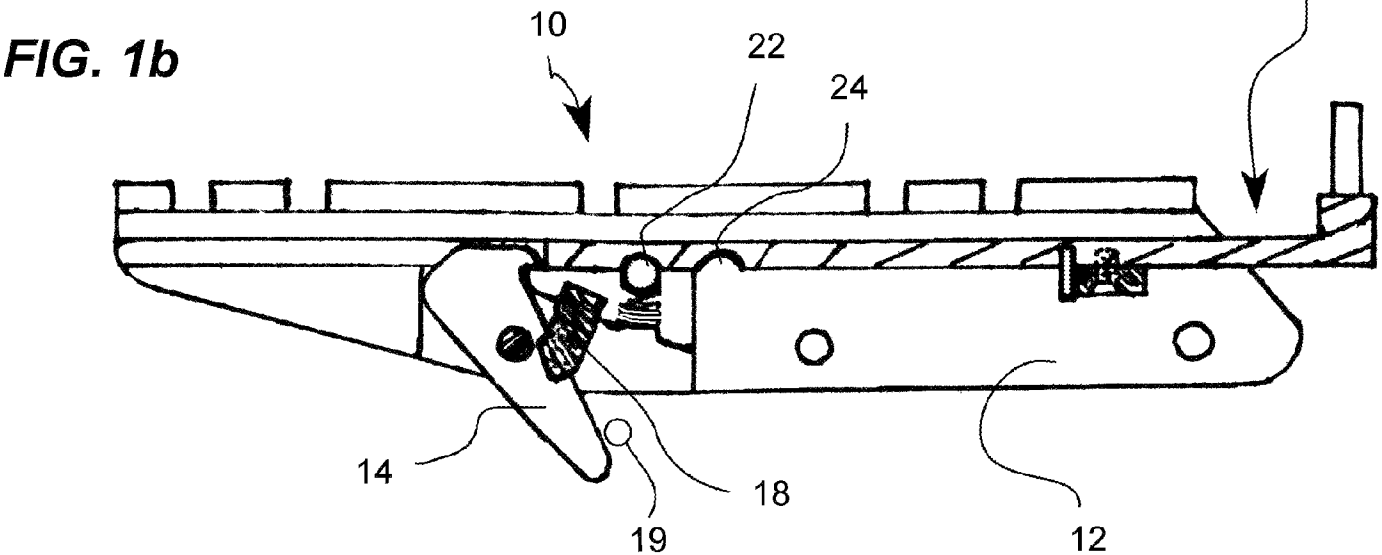
Figure 2A:
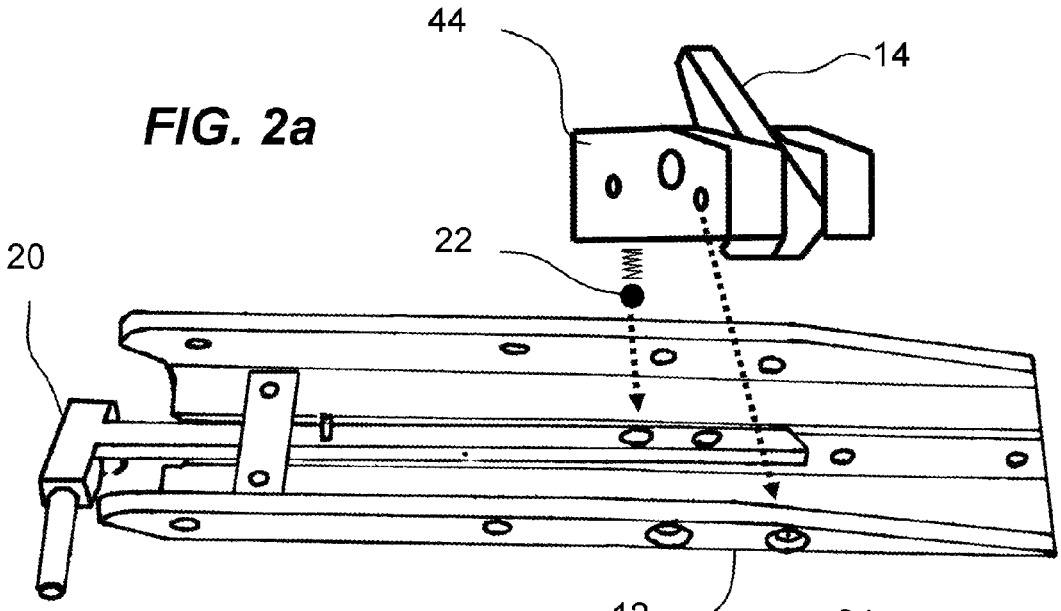
FIGS. 2*a-c* Perspective views of the invention.
Figure 2B:
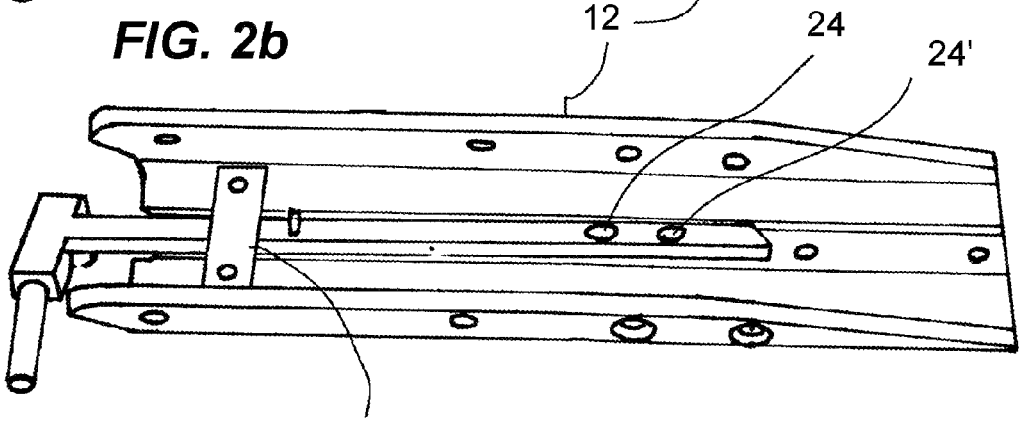
Figure 2C:
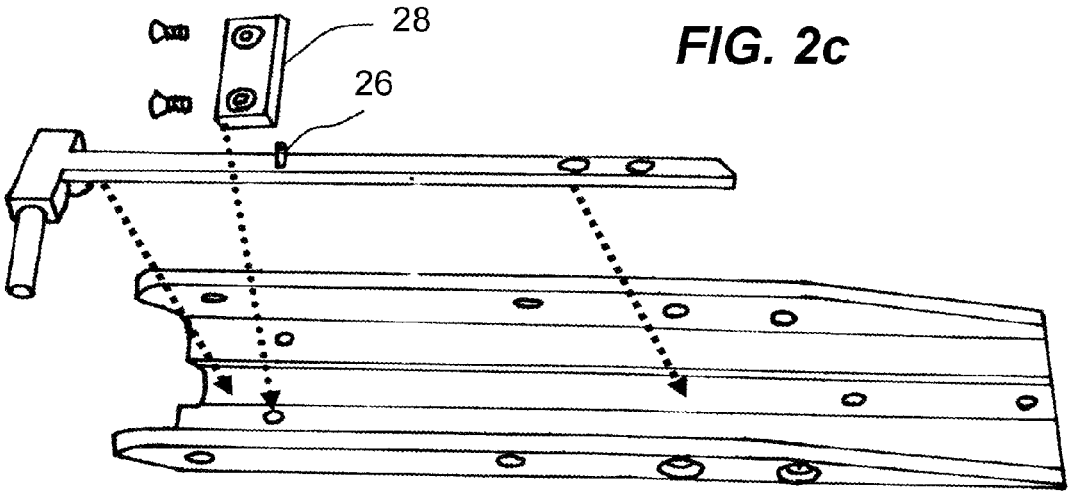

A biased ball bearing (22) is selectively biased from a first cavity (24) to a second cavity (24') when the lock-unlock means (20) is moved, as can be seen by comparing FIG. 1*a* with FIG. 1*b*. A stop (26) and block (28) restrain the range of motion of the lock-unlock means (20).

In operation, a user pulls on the crossbow string (19) so as to engage it under tension, as is known in the art. This can be done even if the catch is down since it operates like the pawl of a ratchet for one way passage of the string (19) but with a blockage the other way around. When ready to fire, the user simply pushes on the lock-unlock means (20) to lift the catch (14) and allow the string (19) to shoot the arrow (not shown).

Besides preventing dry-fire, the device can also act as a safety device to prevent accidental triggering when the arrow (not shown) is loaded.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

The invention claimed is:

1. An anti dry-fire device for crossbows mounted on a viewfinder mount and comprising:

a catch rotationally attached to a catch holder by way of an attachment pin;

a catch biasing means to bias the catch;

a lock-unlock means slidingly engaged on the top of the viewfinder mount;

the lock-unlock means moving the catch from an operative mode into an inoperative mode.

2. An anti dry-fire device as in claim 1 wherein:

a biased ball bearing is selectively biased from a first cavity to a second cavity when the lock-unlock means is moved from unlock mode to lock mode.

3. An anti dry-fire device as in claim 1 wherein:

an existing crossbow's viewfinder mount is retrofitted with the catch rotationally attached to the catch holder by way of the attachment pin;

the catch biasing means to bias the catch;

the lock-unlock means slidingly engaged on the top of the viewfinder mount;

the lock-unlock means moving the catch from an operative mode into an inoperative mode.

4. An anti dry-fire device as in claim 1 wherein:

a stop and block restrain the range of motion of the lock-unlock means.

5. An anti dry-fire device having a mode of operation consisting in the steps of:

a user pulling a lock-unlock means in a direction opposite the way an arrow is to be released so as to allow a catch to pivot in an orientation that causes the catch to block the release of a string after the user has pulled the string so that the string passes the catch which allows passage of the string in one direction but not in the opposite direction;

the user loads an arrow;

the user, when ready to fire, pushes the lock-unlock means in the way the arrow is to be released so as to pivot the catch out of the way of the string;

the user pulls the trigger to release the string and throw the arrow.

* * * * *